US011368791B2

(12) United States Patent
Guo et al.

(10) Patent No.: US 11,368,791 B2
(45) Date of Patent: Jun. 21, 2022

(54) SPEAKER VIBRATION DIAPHRAGM AND METHOD FOR MANUFACTURING THE SAME, AND MOVING-COIL SPEAKER

(71) Applicant: GOERTEK INC., Weifang (CN)

(72) Inventors: Xiaodong Guo, Weifang (CN); Wenhai Wang, Weifang (CN)

(73) Assignee: GOERTEK INC., Weifang (CN)

( * ) Notice: Subject to any disclaimer, the term of this patent is extended or adjusted under 35 U.S.C. 154(b) by 155 days.

(21) Appl. No.: 16/080,878

(22) PCT Filed: Jul. 15, 2016

(86) PCT No.: PCT/CN2016/090204

§ 371 (c)(1),
(2) Date: Aug. 29, 2018

(87) PCT Pub. No.: WO2017/148077

PCT Pub. Date: Sep. 8, 2017

(65) Prior Publication Data

US 2021/0274284 A1 Sep. 2, 2021

(30) Foreign Application Priority Data

Mar. 4, 2016 (CN) ..... 201610124618.8
Mar. 4, 2016 (CN) ..... 201610124968.4
Mar. 4, 2016 (CN) ..... 201610125578.9

(51) Int. Cl.
*H04R 7/04* (2006.01)
*H04R 9/02* (2006.01)
*H04R 9/06* (2006.01)

(52) U.S. Cl.
CPC ..... *H04R 7/04* (2013.01); *H04R 9/025* (2013.01); *H04R 9/06* (2013.01)

(58) Field of Classification Search
CPC combination set(s) only.
See application file for complete search history.

(56) References Cited

U.S. PATENT DOCUMENTS 10,264,360 B2 * 4/2019 Shao ..... H04R 7/18
10,681,464 B2 * 6/2020 Kim ..... H04R 7/02
(Continued)

FOREIGN PATENT DOCUMENTS

CN 201185477 Y 1/2009
CN 103731793 A 4/2014
(Continued)

*Primary Examiner* — Angelica M McKinney
(74) *Attorney, Agent, or Firm* — Saliwanchik, Lloyd & Eisenschenk

(57) ABSTRACT

The present invention discloses a speaker vibration diaphragm. The speaker vibration diaphragm comprises: a vibration diaphragm body, and a graphene film used as a conductive layer and compounded to one side surface of the vibration diaphragm body. The present invention further discloses a method for manufacturing the speaker vibration diaphragm, and a moving-coil speaker provided with the speaker vibration diaphragm. The speaker vibration diaphragm of the present invention comprises a vibration diaphragm body and a graphene film compounded to one side surface of the vibration diaphragm body. The speaker vibration diaphragm has the advantages of good conductivity, and the like.

6 Claims, 5 Drawing Sheets

(56) References Cited

U.S. PATENT DOCUMENTS

| | | | | |
|---|---|---|---|---|
| 2014/0087133 | A1* | 3/2014 | Huang | G10K 13/00 428/138 |
| 2015/0183203 | A1 | 7/2015 | Zhu | |
| 2015/0264486 | A1 | 9/2015 | Yuan et al. | |
| 2018/0035212 | A1 | 2/2018 | Shao et al. | |
| 2018/0077495 | A1* | 3/2018 | Liu | H04R 31/003 |
| 2019/0058955 | A1* | 2/2019 | Voutilainen | H04R 7/06 |

FOREIGN PATENT DOCUMENTS

| | | | | |
|---|---|---|---|---|
| CN | 103781013 | A | | 5/2014 |
| CN | 203933934 | U | | 11/2014 |
| CN | 104320741 | | * | 1/2015 |
| CN | 104320741 | A | | 1/2015 |
| CN | 105142078 | A | | 12/2015 |
| CN | 204948356 | U | | 1/2016 |
| CN | 205029868 | U | | 2/2016 |
| CN | 105681985 | A | | 6/2016 |
| EP | 2934023 | A1 | | 10/2015 |

* cited by examiner

SPEAKER VIBRATION DIAPHRAGM AND METHOD FOR MANUFACTURING THE SAME, AND MOVING-COIL SPEAKER

TECHNICAL FIELD

The present invention relates to a speaker technology, and in particular, to a speaker vibration diaphragm, a method for manufacturing the speak vibration diaphragm, and a moving-coil speaker.

BACKGROUND

Compared with an ordinary power amplifier circuit, a smart power amplifier (Smart PA) increases a feedback on an output signal of a speaker. The smart PA adjusts a power smartly according to an input audio signal and a feedback signal. With the application of a smart PA technology in a speaker, a conductive design needs to be applied to a vibration system of the speaker more and more widely to achieve the feedback on the output signal of the speaker. The current conductive layer designs involve the following two forms: 1) when various metal foils and flexible circuit boards (FPC) are used as the conductive layer, such a conductive layer design has favorable conductivity, but has a relatively greater impact on the performance and volume of the speaker product owing to heavy weight and large thickness of the conductive layer materials; 2) when a metal coating is used as a conductive layer, such a conductive layer has the advantages of good conductivity, light weight, and small thickness, but the metal coating layer has poor bending resistance and is easy to break. Therefore, it is necessary to propose a new conductive layer design.

SUMMARY

An objective of the present invention is to provide a speaker vibration diaphragm with a conductive layer. In addition, such a conductive layer design can at least solve one of the technical problems described above.

According to the first aspect of the present invention, there is provided a speaker vibration diaphragm, which comprises a vibration diaphragm body, and a graphene film used as a conductive layer and compounded to one side surface of the vibration diaphragm body.

Preferably, the thickness of the graphene film is 2 μm.

Preferably, the vibration diaphragm body comprises a PEEK film or a PI film.

The vibration diaphragm body is a composite film which comprises a PEEK film and a TPU film that are compounded together, wherein the graphene film is compounded to the outer surface of the PEEK film.

Preferably, the vibration diaphragm body is a thermoplastic elastomer material film.

Preferably, the thermoplastic elastomer material film is a thermoplastic polyurethane elastomer film or a thermoplastic elastomer-olefine film.

Preferably, the thermoplastic elastomer material film comprises a planar portion located in the center, and a bent rim portion located on the edge of the planar portion, wherein the graphene film is only compounded to the planar portion of the thermoplastic elastomer material film.

Preferably, the vibration diaphragm body is a silica gel vibration diaphragm body.

Preferably, the silica gel vibration diaphragm body comprises a planar portion located in the center, and a bent rim portion located on the edge of the planar portion, wherein the graphene film is only compounded to the planar portion of the silica gel vibration diaphragm body.

According to the second aspect of the present invention, there is provided a moving-coil speaker, which comprises a magnetic circuit system and a vibration system located above the magnetic circuit system, wherein the vibration system comprises a voice coil and the speaker vibration diaphragm of any one of claims 1 to 9, and the graphene film of the speaker vibration diaphragm is compounded to the upper surface of the vibration diaphragm body.

Preferably, the moving-coil speaker further comprises a housing for receiving the magnetic circuit system and the vibration system, and a graphene polar plate fixed to the inner side of the housing; the graphene polar plate is located above the vibration system and is parallel to the graphene film of the speaker vibration diaphragm; the graphene polar plate fixed to the inner side of the housing and the graphene film of the speaker vibration diaphragm form a graphene capacitor.

According to the third aspect of the present invention, there is provided a method for manufacturing a speaker vibration diaphragm, comprising the following steps:

providing the vibration diaphragm body, and performing a surface activation process on one side surface of the vibration diaphragm body; and depositing graphene on the side surface of the vibration diaphragm body to form a graphene film, thereby forming the speaker vibration diaphragm.

According to the fourth aspect of the present invention, there is provided a method for manufacturing a speaker vibration diaphragm, comprising the following steps:

performing a surface activation process on a thermoplastic elastomer material film;

depositing graphene on the surface of the activated thermoplastic elastomer material film to form a composite film comprising the thermoplastic elastomer material film and a graphene film; and performing a molding process on the composite film to form the speaker vibration diaphragm.

According to the fifth aspect of the present invention, there is provided a method for manufacturing a speaker vibration diaphragm, comprising the following steps:

preparing a graphene film on the surface of a substrate to form a composite film comprising the substrate and the graphene film;

performing a molding process on the composite film, such that the shape of the composite film is identical with the shape of the speaker vibration diaphragm to be formed;

removing the molded graphene film from the molded composite film; and forming a silica gel vibration diaphragm body, which is compounded with the molded graphene film together, on one side of the molded graphene film.

Preferably, said forming the silica gel vibration diaphragm body, which is compounded with the molded graphene film together, on one side of the molded graphene film comprises the following steps:

placing the molded graphene film into a silica gel molding tool, and adding liquid silica gel to one side of the molded graphene film by gluing or injection; and performing a vulcanization molding process on the liquid silica gel to form the silica gel vibration diaphragm body.

Preferably, the substrate is a metal foil.

Preferably, the substrate is a copper foil.

Preferably, prior to the preparation of the graphene film on the surface of the substrate, the method further comprises a step of performing a process of reducing the surface activity on the surface of the substrate.

The inventors of the present invention have found that in the prior art, there is no technical solution in which a graphene film is compounded to one side surface of a vibration diaphragm body as a conductive layer. Therefore, the technical task to be achieved by the present invention or the technical problem to be solved by the present invention is never conceived or expected by a person skilled in the art, so the present invention is a new technical solution.

Other features and advantages of the present invention will become apparent through the detailed descriptions of the exemplary embodiments of the present invention with reference to the drawings.

BRIEF DESCRIPTION OF THE DRAWINGS

The drawings that are integrated into the description and constitute a part of the description show the embodiments of the present invention and are intended to explain the principle of the present invention together with the descriptions thereof.

DETAILED DESCRIPTION

Now, various exemplary embodiments of the present invention will be described in detail with reference to the drawings. It should be noted that, unless specified otherwise, the relative arrangements of the members and steps, the mathematical formulas and numerical values described in these embodiments do not restrict the scope of the present invention.

The following descriptions for at least one exemplary embodiment are actually descriptive only, and shall not be intended to limit the invention and any application or use thereof.

The techniques, methods and devices well known to those skilled in the related arts may not be discussed in detail. However, where applicable, such techniques, methods and devices should be deemed as a part of the description.

Any specific value shown herein and in all the examples should be interpreted as illustrative only rather than restrictive. Therefore, other examples of the exemplary embodiments may include different values.

It should be noted that similar signs and letters in the following drawings represent similar items. Therefore, once defined in one drawing, an item may not be further discussed in the followed drawings.

Embodiment 1

Figure 1:
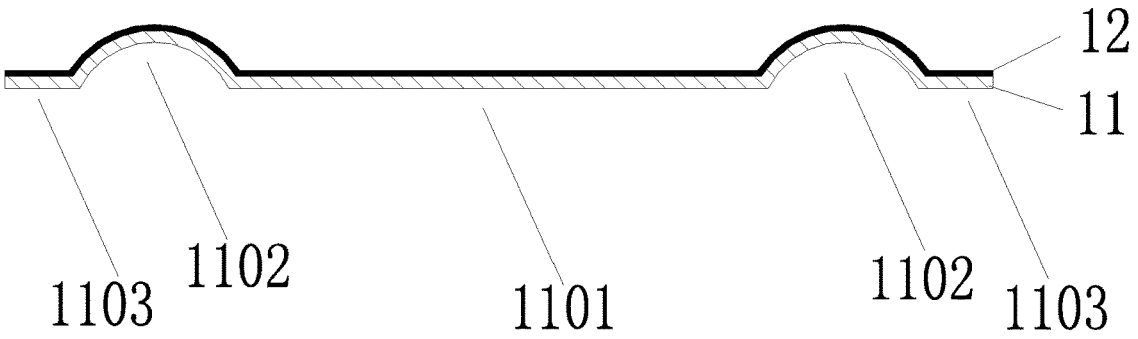
FIG. 1 is a schematic structural diagram of a speaker vibration diaphragm provided by the first embodiment of the present invention.

FIG. 1 illustrates the first embodiment of a speaker vibration diaphragm of the present invention.

The speaker vibration diaphragm comprises a thermoplastic elastomer (TPE) material film 11 and a graphene film 12 compounded to one side surface of the thermoplastic elastomer material film 11, wherein the graphene film 12 serves as a conductive layer. The thermoplastic elastomer material film 11 may be, for example, a thermoplastic polyurethane elastomer (TPU) film or a thermoplastic elastomer-olefine (TPE-O) film.

The graphene film 12 cannot be too thin; otherwise, the conductivity thereof will be affected and the preparation difficulty will be increased. However, the graphene film 12 cannot be too thick either; otherwise, it will occupy a vibration space of the speaker vibration diaphragm, thereby affecting the performance and volume of the speaker. In comprehensive consideration of these factors, in a specific embodiment of the present invention, the thickness of the graphene film 12 is preferably 2 μm.

As can be seen from FIG. 1, the thermoplastic elastomer material film 11 comprises a planar portion 1101 located in the center, a bent rim portion (surround) 1102 located on the edge of the planar portion 1101, and a fixing portion 1103 located on the outermost periphery and used for being adhesively fixed with a speaker housing. The graphene film 12 is compounded to the entire area of the thermoplastic elastomer material film 11. That is, the graphene film 12 is compounded to the planar portion 1101, the bent rim portion 1102 and the fixing portion 1103 of the thermoplastic elastomer material film 11 simultaneously. In another embodiment of the present invention, the graphene film 12 may be only compounded to the planar portion 1101 of the thermoplastic elastomer material film 11.

Figure 2:
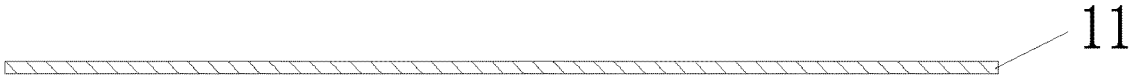
FIGS. 2-4 are schematic diagrams of a manufacturing process of the speaker vibration diaphragm provided by the first embodiment of the present invention.
Figure 3:
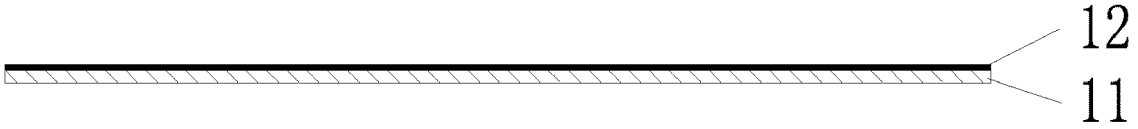
Figure 4:
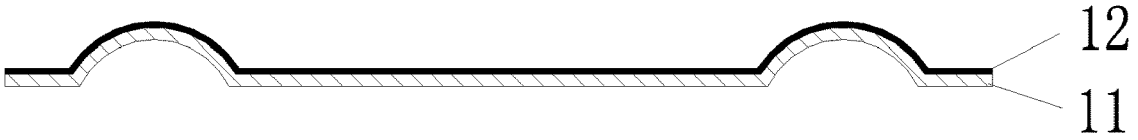

FIGS. 2-4 illustrate a manufacturing process of the speaker vibration diaphragm provided by the first embodiment of the present invention. The manufacturing process comprises the following steps.

In 1*a*), as shown in FIG. 2, the thermoplastic elastomer material film 11 is subjected to a surface activation process, such as a plasma surface activation process.

In 1*b*), as shown in FIG. 3, graphene is deposited on the surface of the activated thermoplastic elastomer material film 11 to form a composite film comprising the thermoplastic elastomer material film 11 and a graphene film 12. Since the thermoplastic elastomer material film 11 is subjected to the surface activation process, the graphene film 12 can be better adhered to the surface of the thermoplastic elastomer material film 11.

In 1*c*), as shown in FIG. 4, the composite film is subjected to a molding process to form a speaker vibration diaphragm. Both the thermoplastic elastomer material film 11 and the graphene film 12 have elasticity and can thus be easily molded to form the speaker vibration diaphragm. The molding process is preferably a hot press molding process. At a high temperature, the surface of the thermoplastic elastomer material film 11 melts and becomes sticky, such that the thermoplastic elastomer material film 11 and the graphene film 12 may be bonded more closely to prevent the separation therebetween.

Embodiment 2

Figure 5:
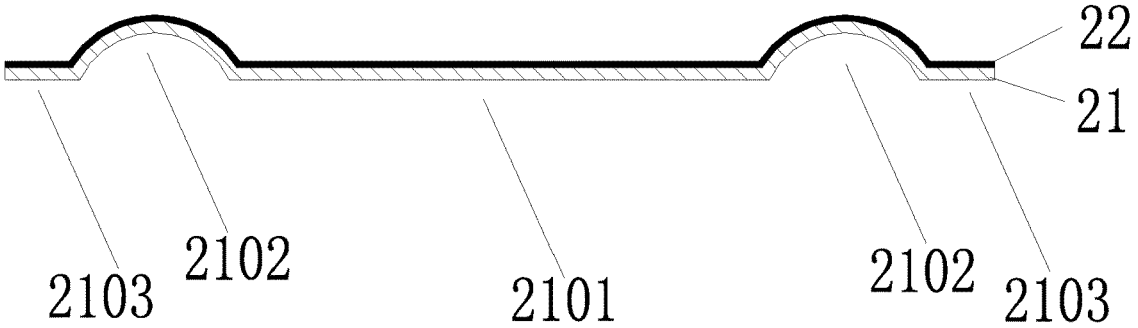
FIG. 5 is a schematic structural vibration diaphragm of the speaker vibration diaphragm provided by the second embodiment of the present invention.

FIG. 5 illustrates the second embodiment of the speaker vibration diaphragm of the present invention.

The speaker vibration diaphragm comprises a vibration diaphragm body 21 and a graphene film 22 compounded to one side surface of the vibration diaphragm body 21, wherein the graphene film 22 serves as a conductive layer.

The vibration diaphragm body 21 comprises a PEEK film or a PI film. The vibration diaphragm body 21 may be a PEEK (polyetheretherketone) single-layer film, a PI (Polyimide) single-layer film, a PEEK double-layer film, a PI double-layer film, or a composite film.

When the vibration diaphragm body 21 is a PEEK double-layer film, an adhesive layer may be arranged between two layers of PPEK films. The two layers of PEEK films are connected through an adhesive layer.

The vibration diaphragm body 21 may be a composite film, such as a PEEK film and a TPU (Thermoplastic polyurethane Elastomer) film which are compounded together. The graphene film 22 is compounded to the outer surface of the PEEK film. The outer surface of the PEEK film refers to one side surface of the PEEK film away from the TPU film. An adhesive layer may be arranged between the PEEK film and the TPU film. The PEEK film and the TPU film are connected through the adhesive layer. There may also be no adhesive layer between the PEEK film and the TPU film. The TPU film softens itself at a high temperature, and therefore its surface viscosity is significantly enhanced. At this time, the TPU film may be attached to the PEEK film. After the temperature decreases, the viscosity of the TPU film is reduced, and therefore the bonding surface between the TPU film and the PEEK film remains in an attached state.

The graphene film 22 cannot be too thin; otherwise, the conductivity thereof will be affected and the preparation difficulty will be increased. However, the graphene film 12 cannot be too thick either; otherwise, it will occupy a vibration space of the speaker vibration diaphragm, thereby affecting the performance and volume of the speaker. In comprehensive consideration of these factors, in a specific embodiment of the present invention, the thickness of the graphene film 22 is preferably 2 μm.

As can be seen from FIG. 5, the vibration diaphragm body 1 comprises a planar portion 2101 located in the center, a bent rim portion 2102 located on the edge of the planar portion 2101, and a fixing portion 2103 located on the outermost periphery and used for being adhesively fixed with the speaker housing. The graphene film 22 is compounded to the entire area of the vibration diaphragm body 21. That is, the graphene film 22 is compounded to the planar portion 2101, the bent rim portion 2102 and the fixing portion 2103 of the vibration diaphragm body 11 simultaneously. In another embodiment of the present invention, the graphene film 22 may be only compounded to the planar portion 2101 of the vibration diaphragm body 21.

Figure 6:
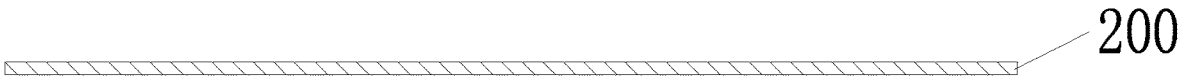
FIGS. 6-8 are schematic diagrams of a manufacturing process of the speaker vibration diaphragm provided by the second embodiment of the present invention.
Figure 7:
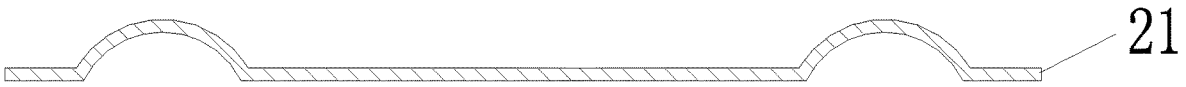
Figure 8:
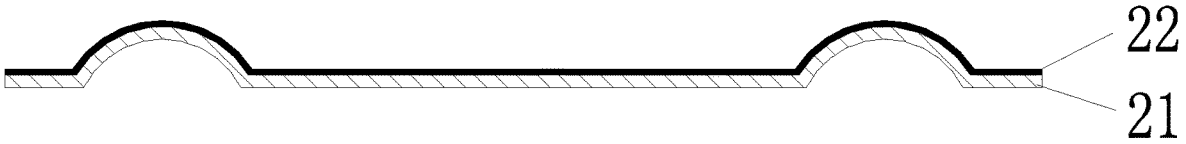

FIGS. 6-8 illustrate a manufacturing process of the speaker vibration diaphragm provided by the second embodiment of the present invention. The manufacturing process comprises the following steps.

In 2*a*), as shown in FIG. 6, a vibration diaphragm body material film 200 is provided.

In 2*b*), as shown in FIG. 7, the vibration diaphragm body material film 200 is subjected to a molding process to form the vibration diaphragm body 21, wherein the molding process may be a hot press molding process.

In 2*c*), as shown in FIG. 8, graphene is deposited on one side surface of the vibration diaphragm body 21 to form the graphene film 22, thereby forming the speaker vibration diaphragm. Before deposition, the side surface of the vibration diaphragm body 21 may be subjected to a surface activation process, such as a plasma surface activation process. Since the side surface of the vibration diaphragm body 21 is subjected to the surface activation process, the graphene film 22 can be better attached to the side surface of the vibration diaphragm body 21. The graphene may be deposited by chemical vapor deposition.

If the graphene film is deposited on one side surface of the vibration diaphragm body material film 200 first, and the graphene film and the vibration diaphragm body material film 200 are then integrally formed by hot pressing to form a vibration diaphragm, the bonding degree between the graphene film and the vibration diaphragm body material film 200 may decrease because of mismatching of tensile levels of the graphene film and the vibration diaphragm body material film 200. This case can be avoided effectively in the second embodiment by placing the step 2*b*) of performing the molding process on the vibration diaphragm body material film 200 to form the vibration diaphragm body 21 before the step 2*c*) of depositing the graphene.

Embodiment 3

Figure 9:
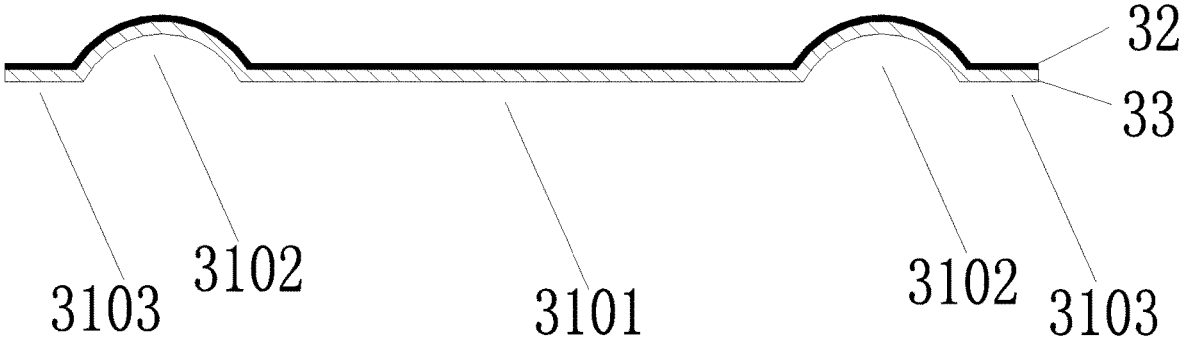
FIG. 9 is a schematic structural diagram of the speaker vibration diaphragm provided by the third embodiment of the present invention.

FIG. 9 illustrates the third embodiment of the speaker vibration diaphragm of the present invention.

The speaker vibration diaphragm comprises a silica gel vibration diaphragm body 33 and a graphene film 32 compounded to one side surface of the silica gel vibration diaphragm body 33, wherein the graphene film 32 serves as a conductive layer.

The graphene film 32 cannot be too thin; otherwise, the conductivity thereof will be affected and the preparation difficulty will be increased. However, the graphene film 32 cannot be too thick either; otherwise, it will occupy a vibration space of the speaker vibration diaphragm, thereby affecting the performance and volume of the speaker. In comprehensive consideration of these factors, in a specific embodiment of the present invention, the thickness of the graphene film 32 is preferably 2 μm.

As can be seen from FIG. 9, the silica gel vibration diaphragm body 33 comprises a planar portion 3101 located in the center, a bent rim portion 3102 located on the edge of the planar portion 3101, and a fixing portion 3103 located on the outermost periphery and used for being adhesively fixed with the speaker housing. The graphene film 32 is compounded to the entire area of the silica gel vibration body 33. That is, the graphene film 32 is compounded to the planar portion 3101, the bent rim portion 3102 and the fixing portion 3103 of the silica gel vibration diaphragm body 33 simultaneously. In another embodiment of the present invention, the graphene film 32 may be only compounded to the planar portion 3101 of the silica gel vibration diaphragm body 33.

Figure 16:
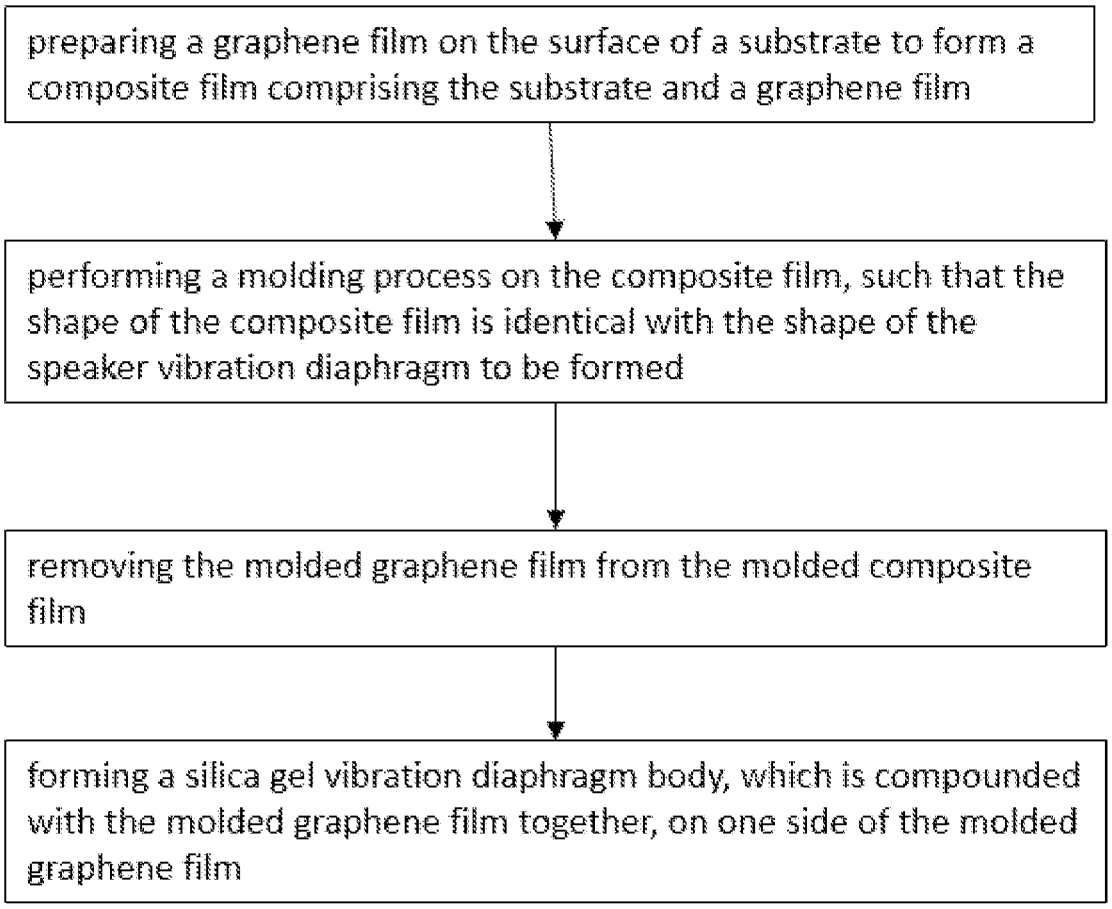
FIG. 16 shows a flow chart of the process.

FIGS. 10-14 illustrate a manufacturing process of the speaker vibration diaphragm provided by the third embodiment of the present invention. FIG. 16 shows a flow chart of the process. The manufacturing process comprises the following steps.

Figure 10:
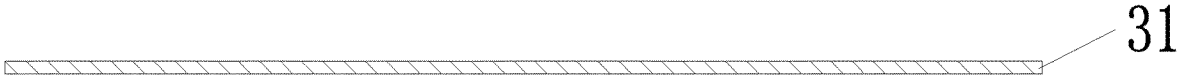
FIGS. 10-14 are schematic diagrams of a manufacturing process of the speaker vibration diaphragm provided by the third embodiment of the present invention.

In 3*a*), as shown in FIG. 10, a substrate 31 is provided, and the surface of the substrate 31 is treated to reduce the surface activity of the substrate 31. The substrate 1 may be a metal foil, preferably a copper foil.

Figure 11:
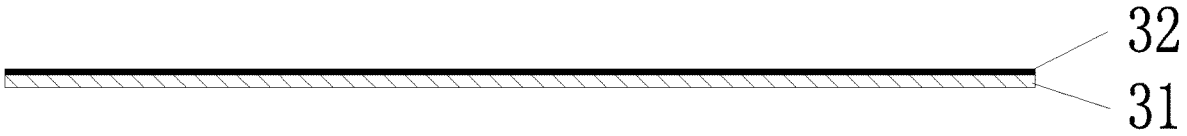

In 3*b*), as shown in FIG. 11, a graphene film 32 is prepared on the surface of the substrate 31 to form a composite film comprising the substrate 31 and the graphene film 32. Graphene may be disposed on the surface of the substrate 31 by chemical vapor deposition to form the graphene film 32.

Figure 12:
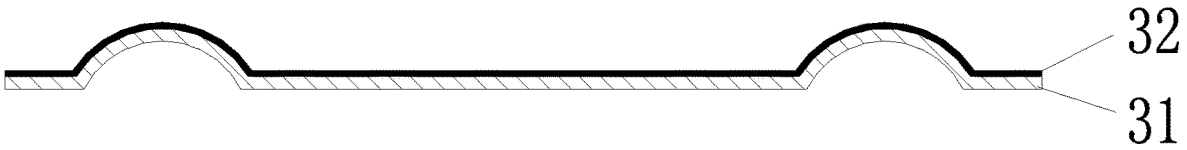

In 3*c*), as shown in FIG. 12, the composite film is subjected to a molding process, such that the shape of the composite film is identical with the shape of the speaker vibration diaphragm to be formed finally.

Figure 13:
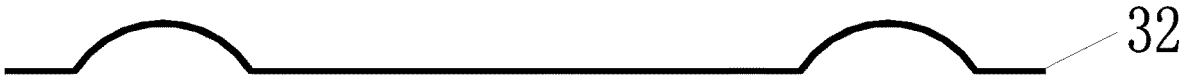

In 3*d*), as shown in FIG. 13, the molded graphene film 32 is removed from the molded composite film. Since the surface of the substrate 31 is subjected to an activity reduction process, the substrate 31 and the graphene film 32 may not be bonded very closely, and therefore the substrate 31 may be separated from the graphene film 32 easily.

Figure 14:
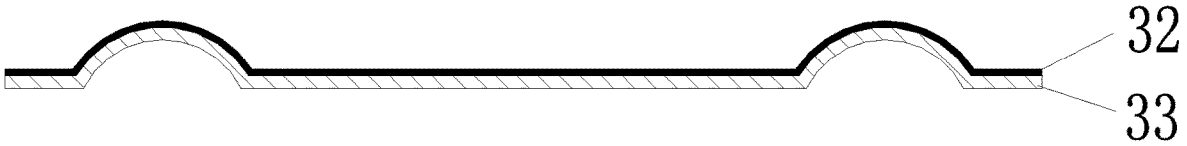

In e), as shown in FIG. 14, a silica gel vibration diaphragm body 33, which is compounded with the molded graphene film 32 together, is formed on one side of the molded graphene film 32. In this step, the molded graphene film 32 may be placed into a silica gel molding tool first, and liquid silica gel may be added to one side of the molded graphene film 32 by gluing or injection. The liquid silica gel is subjected to a vulcanization molding process to form the silica gel vibration diaphragm body 33.

The speaker vibration diaphragm of the present invention comprises a vibration diaphragm body and a graphene film which are compounded together. Compared with a metal foil and a flexible circuit board which serve as a conductive layer, the graphene film is light in weight and small in thickness, substantially has no impact on the compliance of a vibration system, and enhances the performance of the speaker product. Preferably or alternatively, the graphene film is small in thickness, and has no impact on a vibration space of the vibration system of the speaker and the volume of the speaker product. Preferably or alternatively, compared with a metal coating serving as a conductive layer, the graphene film has good bending resistance and is not easy to break. Preferably or alternatively, since graphene has excellent conductivity and an extremely high charge/discharge speed, a detection capacitor composed of graphene can monitor a vibration displacement of the speaker vibration diaphragm in time.

Figure 15:
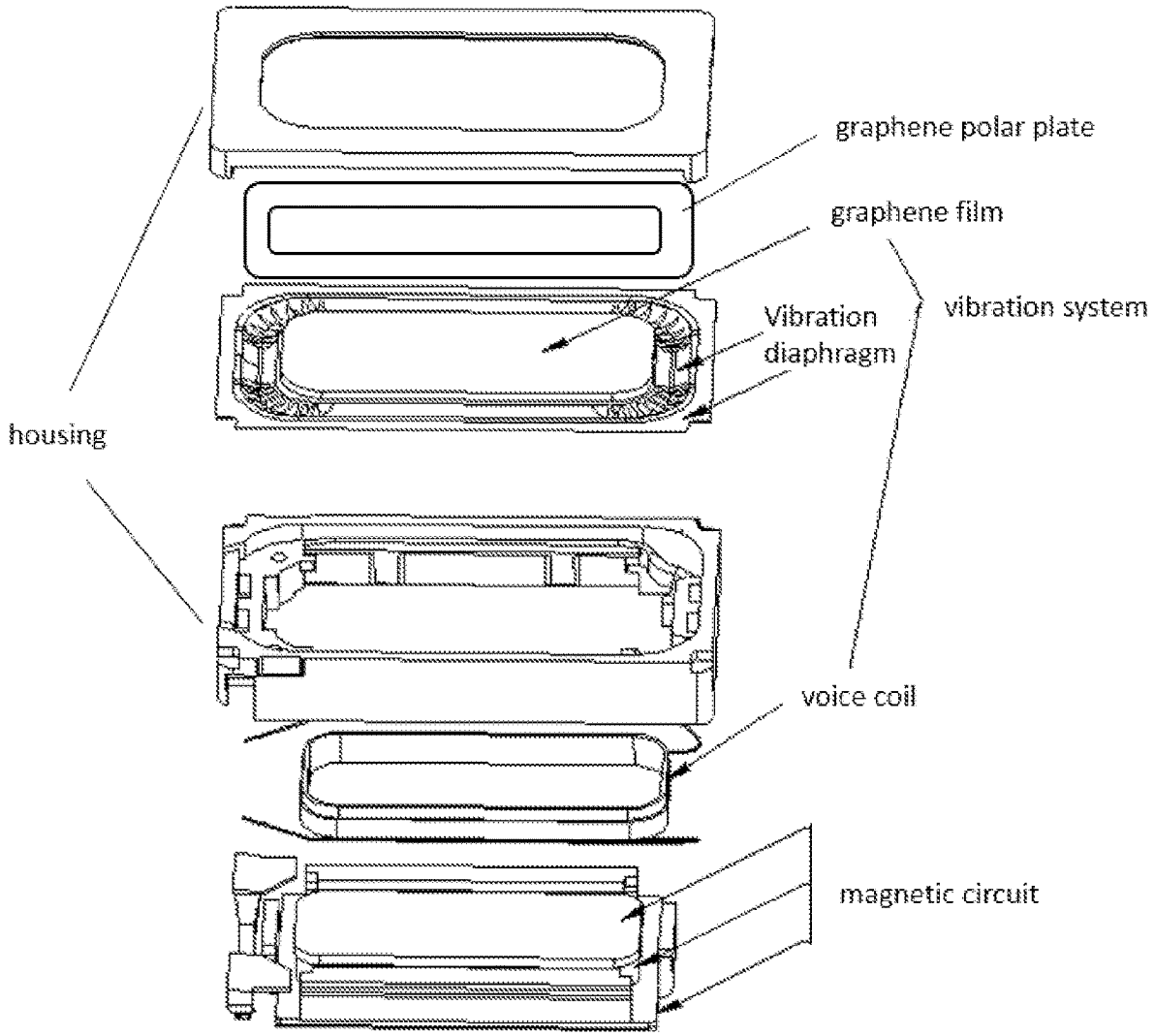
FIG. 15 shows a moving-coil speaker of an embodiment of the present invention.

The present invention further provides a moving-coil speaker, as show in FIG. 15. The moving-coil speaker comprises a magnetic circuit system and a vibration system located above the magnetic circuit system. The vibration system comprises a voice coil and the speaker vibration diaphragm as described above. The graphene film of the speaker vibration diaphragm is compounded to the upper surface of the vibration diaphragm body. The moving-coil speaker further comprises a housing for receiving the magnetic circuit system and the vibration system, and a graphene polar plate fixed to the inner side of the housing. The graphene polar plate is located above the vibration system and is parallel to the graphene film of the speaker vibration diaphragm. The graphene polar plate fixed to the inner side of the housing and the graphene film of the speaker vibration diaphragm form a graphene capacitor. The graphene capacitor can be used to detect a vibration displacement of the speaker vibration diaphragm. When the vibration system of the speaker vibrates, a distance between the graphene polar plate fixed to the inner side of the housing and the graphene film of the speaker vibration diaphragm changes to cause a change in the capacitance value of the graphene capacitor. The actual displacement of the speaker vibration diaphragm may be calculated by directly monitoring a numerical change of the graphene capacitor or indirectly monitoring a current change of a circuit connected with the capacitor. Since graphene has excellent conductivity and an extremely high charge/discharge speed, a detection capacitor composed of graphene can monitor a vibration displacement of the speaker vibration diaphragm in time.

The graphene polar plate fixed to the inner side of the speaker housing may be configured to be attached by a corresponding graphene layer on the corresponding substrate by vapor deposition or chemical vapor deposition. The vapor deposition and the chemical vapor deposition are known means and will not be described here. In order to prevent capacitive charges from flowing into a conductive medium made of other materials, in a specific embodiment of the present invention, the substrate to which the graphene layer is attached is made of an insulating material.

The shape, thickness, area and the like of the graphene polar plate fixed to the inner side of the speaker housing may be identical with or different from those of the graphene film of the speaker vibration diaphragm respectively. However, in order to improve the structural symmetry of two polar plates of the graphene capacitor and further facilitate the calculation of the vibration displacement of the speaker vibration diaphragm according to the change in the capacitance value of the graphene capacitor, in a specific embodiment of the present invention, the shape and size of the graphene polar plate fixed to the inner side of the speaker housing are identical with those of the graphene film of the speaker vibration diaphragm respectively.

In order to transmit capacitance value change-related data of the graphene capacitor to a circuit for calculating a vibration displacement of the speaker vibration diaphragm according to the capacitance change, in a specific embodiment of the present invention, the graphene polar plate fixed to the inner side of the speaker housing and the graphene film of the speaker vibration diaphragm are respectively connected to a corresponding pad of the moving-coil speaker via a connection lead.

While certain specific embodiments of the present invention have been illustrated by way of example, it will be understood by those skilled in the art that the foregoing examples are provided for the purpose of illustration and are not intended to limit the scope of the present invention. It will be understood by those skilled in the art that the foregoing embodiments may be modified without departing from the scope and spirit of the invention. The scope of the present invention is subject to the attached claims.

The invention claimed is:

1. A moving-coil speaker, comprising:

a magnetic circuit system; and a vibration system located above the magnetic circuit system;

wherein the vibration system comprises a voice coil and a speaker vibration diaphragm, wherein the speaker vibration diaphragm comprises a vibration diaphragm body and a graphene film used as a conductive layer and compounded to one side surface of the vibration diaphragm body, wherein the graphene film of the speaker vibration diaphragm is compounded to an upper surface of the vibration diaphragm body, wherein the moving-coil speaker further comprises a housing for receiving the magnetic circuit system and the vibration system, and a graphene polar plate fixed to an inner side of the housing, wherein the graphene polar plate is located above the vibration system and is parallel to the graphene film of the speaker vibration diaphragm, and wherein the graphene polar plate fixed to the inner side of the housing and the graphene film of the speaker vibration diaphragm form a graphene capacitor.

2. A method for manufacturing a speaker vibration diaphragm that comprises a vibration diaphragm body and a graphene film used as a conductive layer and compounded to one side surface of the vibration diaphragm body, wherein the vibration diaphragm body is a silica gel vibration diaphragm body, the method comprising the following steps:

preparing the graphene film on the surface of a substrate to form a composite film comprising the substrate and the graphene film;

performing a molding process on the composite film, such that the shape of the composite film is identical with the shape of the speaker vibration diaphragm to be formed;

removing the molded graphene film from the molded composite film; and forming the silica gel vibration diaphragm body, which is compounded with the molded graphene film together, on one side of the molded graphene film.

3. The method according to claim 2, wherein said forming the silica gel vibration diaphragm body, which is compounded with the molded graphene film together, on one side of the molded graphene film comprises the following steps:

placing the molded graphene film into a silica gel molding tool, and adding liquid silica gel to one side of the molded graphene film by gluing or injection; and performing a vulcanization molding process on the liquid silica gel to form the silica gel vibration diaphragm body.

4. The method according to claim 2, wherein the substrate is a metal foil.

5. The method according to claim 2, wherein the substrate is a copper foil.

6. The method according to claim 2, wherein, prior to the preparation of the graphene film on the surface of the substrate, the method further comprises a step of performing a process of reducing the surface activity on the surface of the substrate.

* * * * *